US011326111B1

(12) United States Patent
Koseoglu

(10) Patent No.: US 11,326,111 B1
(45) Date of Patent: May 10, 2022

(54) MULTI-STEP PRESSURE CASCADED HYDROCRACKING PROCESS

(71) Applicant: Saudi Arabian Oil Company, Dhahran (SA)

(72) Inventor: Omer Refa Koseoglu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/201,272

(22) Filed: Mar. 15, 2021

(51) Int. Cl.
*C10G 65/12* (2006.01)
*C10G 45/02* (2006.01)
*C10G 47/00* (2006.01)

(52) U.S. Cl.
CPC ..... *C10G 65/12* (2013.01); *C10G 45/02* (2013.01); *C10G 47/00* (2013.01); *C10G 2300/4012* (2013.01); *C10G 2300/4081* (2013.01); *C10G 2400/04* (2013.01)

(58) Field of Classification Search
CPC ..... C10G 65/12; C10G 45/02; C10G 47/00; C10G 2300/4012; C10G 2300/4081; C10G 2400/04
See application file for complete search history.

(56) References Cited

U.S. PATENT DOCUMENTS

| | | | | |
|---|---|---|---|---|
| 3,317,419 | A | 5/1967 | Fortman | |
| 3,607,725 | A | 9/1971 | Irvine | |
| 4,430,203 | A | 2/1984 | Cash | |
| 8,343,334 | B2 | 1/2013 | Koseoglu | |
| 2016/0369185 | A1 | 12/2016 | Ward et al. | |
| 2018/0163144 | A1* | 6/2018 | Weiss | C10G 31/06 |
| 2019/0040329 | A1* | 2/2019 | Moore | C10G 69/04 |
| 2019/0153340 | A1* | 5/2019 | Weiss | C10G 7/06 |

* cited by examiner

*Primary Examiner* — Randy Boyer
*Assistant Examiner* — Juan C Valencia
(74) *Attorney, Agent, or Firm* — Dinsmore & Shohl LLP

(57) ABSTRACT

In accordance with one or more embodiments of the present disclosure, a process for refining and hydrocracking a hydrocarbon feedstock includes hydrodemetallizing and hydrodesulfurizing the hydrocarbon feedstock thereby yielding a hydrodemetallized and hydrodesulfurized hydrocarbon feedstock; hydrodenitrogenating the hydrodemetallized and hydrodesulfurized hydrocarbon feedstock, thereby yielding a hydrotreated hydrocarbon feedstock; hydrocracking the hydrotreated hydrocarbon feedstock, thereby yielding a hydrocracked hydrocarbon stream; and fractionating the hydrocracked hydrocarbon stream, thereby yielding a plurality of streams selected from the group consisting of a naphtha stream, a diesel stream, an unconverted bottoms stream, and a combination of two or more thereof.

15 Claims, 4 Drawing Sheets

MULTI-STEP PRESSURE CASCADED HYDROCRACKING PROCESS

TECHNICAL FIELD

Embodiments of the present disclosure generally relate to refining hydrocarbon oil, and pertain particularly to a process for refining and hydrocracking a hydrocarbon feedstock.

BACKGROUND

Hydrocracking processes are used commercially in a large number of petroleum refineries to process a variety of hydrocarbon feeds boiling in the range of 370° C. to 565° C. in conventional hydrocracking units and boiling at 565° C. and above in residue hydrocracking units. A hydrocracking process converts heavy oils to transportation fuels by first removing the organic sulfur and nitrogen compounds from a hydrocarbon feed and then splitting the remaining components of the feed into lighter molecules, which have higher average volatility and greater economic value. Hydrocracking processes typically improve the quality of the hydrocarbon feedstock by increasing the hydrogen-to-carbon ratio as the organosulfur and organonitrogen compounds are removed. Regardless of the configuration, a typical hydrocracking process requires high hydrogen partial pressures, i.e. 12 MPa and above, to refine the oil and crack the feedstock, and this pressure is usually throughout the refining processes adjacent to the hydrocracking.

SUMMARY

There is, therefore, a continual need for novel processes for refining and hydrocracking a hydrocarbon feedstock in a manner that allows for an overall reduction in the pressure of the hydrocracking system. Embodiments of the present disclosure are directed to solutions to a pressure cascaded refining and hydrocracking process.

According to one embodiment, a process for refining and hydrocracking a hydrocarbon feedstock includes hydrodemetallizing and hydrodesulfurizing the hydrocarbon feedstock thereby yielding a hydrodemetallized and hydrodesulfurized hydrocarbon feedstock; hydrodenitrogenating the hydrodemetallized and hydrodesulfurized hydrocarbon feedstock, thereby yielding a hydrotreated hydrocarbon feedstock; hydrocracking the hydrotreated hydrocarbon feedstock, thereby yielding a hydrocracked hydrocarbon stream; and fractionating the hydrocracked hydrocarbon stream, thereby yielding a plurality of streams selected from the group consisting of a naphtha stream, a diesel stream, an unconverted bottoms stream, and a combination of two or more thereof. The hydrodemetallizing and hydrodesulfurizing take place in at least one hydrodemetallization/hydrodesulfurization reactor having a hydrogen partial pressure from 4 MPa to 8 MPa. The hydrodenitrogenating takes place in at least one hydrodenitrogenation reactor having a hydrogen partial pressure from 8 MPa to 12 MPa. The hydrocracking takes place in at least one hydrocracking reactor having a hydrogen partial pressure from 12 MPa to 20 MPa. The hydrogen partial pressure of the hydrodemetallization/hydrodesulfurization reactor is less than the hydrogen partial pressure of the hydrodenitrogenation reactor, and the hydrogen partial pressure of the hydrodenitrogenation reactor is less than the hydrogen partial pressure of the hydrocracking reactor.

According to an embodiment, a process for refining and hydrocracking a hydrocarbon feedstock includes hydrodemetallizing and hydrodesulfurizing the hydrocarbon feedstock thereby yielding a hydrodemetallized and hydrodesulfurized hydrocarbon feedstock; hydrodenitrogenating the hydrodemetallized and hydrodesulfurized hydrocarbon feedstock, thereby yielding a hydrotreated hydrocarbon feedstock; fractionating the hydrotreated hydrocarbon feedstock, thereby yielding a plurality of streams, one of the plurality of streams comprising unconverted bottoms; and hydrocracking the unconverted bottoms, thereby yielding one or more hydrocracked hydrocarbon streams selected from the group consisting of a naphtha stream, a diesel stream, an unconverted bottoms stream, and a combination of two or more thereof. The hydrodemetallizing and hydrodesulfurizing take place in at least one hydrodemetallization/hydrodesulfurization reactor at a pressure from 4 MPa to 8 MPa. The hydrodenitrogenating takes place in at least one hydrodenitrogenation reactor at a pressure from 8 MPa to 12 MPa. The hydrocracking takes place in at least one hydrocracking reactor at a pressure from 12 MPa to 20 MPa. The hydrogen partial pressure of the hydrodemetallization/hydrodesulfurization reactor is less than the hydrogen partial pressure of the hydrodenitrogenation reactor, and the hydrogen partial pressure of the hydrodenitrogenation reactor is less than the hydrogen partial pressure of the hydrocracking reactor.

Additional features and advantages of the embodiments described herein will be set forth in the detailed description which follows, and in part will be readily apparent to those skilled in the art from that description or recognized by practicing the embodiments described, including the detailed description and the claims which are provided infra.

BRIEF DESCRIPTION OF THE DRAWINGS

The following detailed description of specific embodiments of the present disclosure can be best understood when read in conjunction with the following drawings in which.

DETAILED DESCRIPTION

Figure 1:
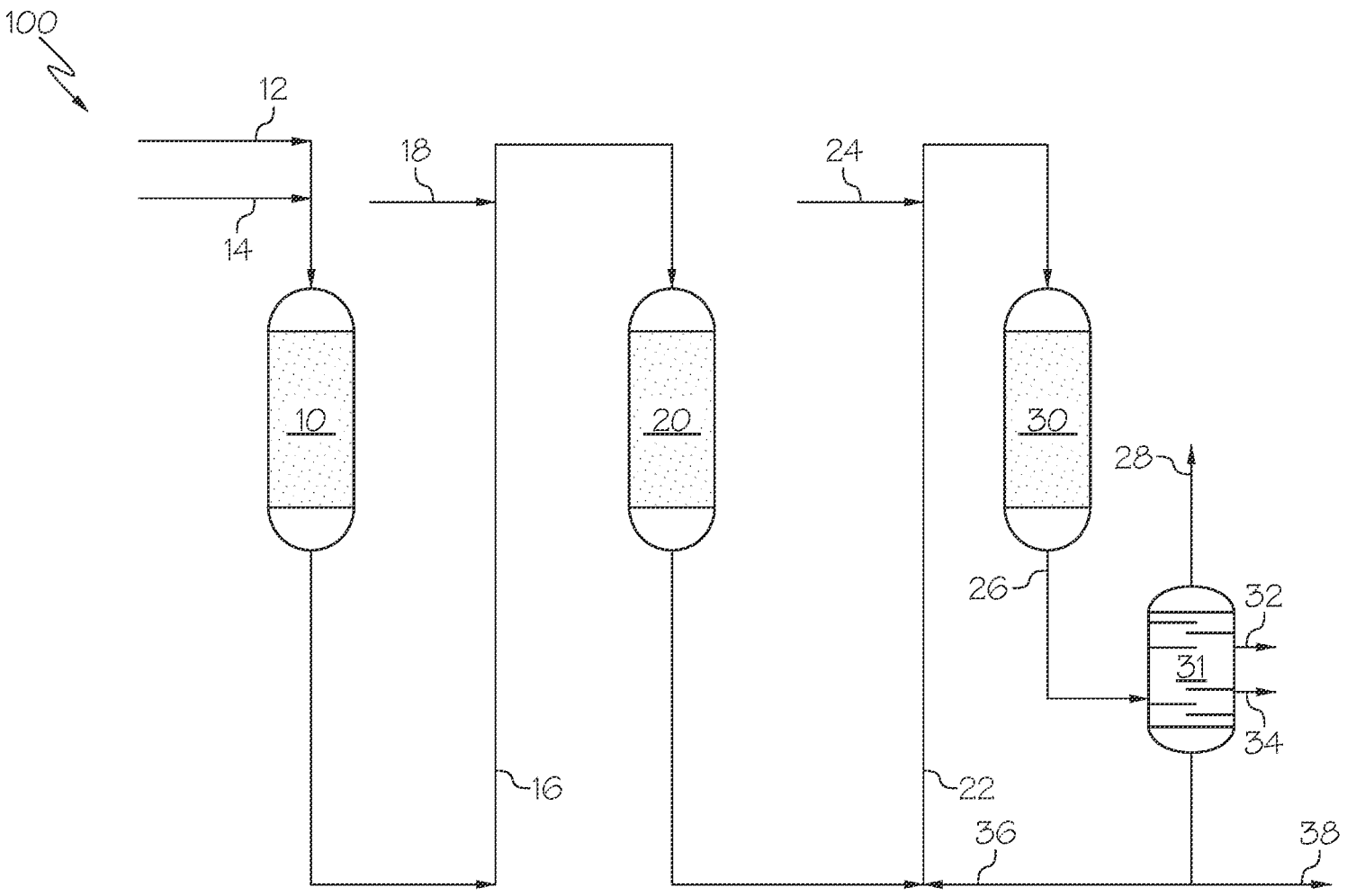
FIG. 1 is a process flow diagram in accordance with embodiments described herein.

Embodiments described herein relate to refining and hydrocracking processes including multiple pressure cascaded stages. In one or more embodiments, a process for refining and hydrocracking a hydrocarbon feedstock includes hydrodemetallizing and hydrodesulfurizing the hydrocarbon feedstock, thereby yielding a hydrodemetallized and hydrodesulfurized hydrocarbon feedstock. Then, the hydrodemetallized and hydrodesulfurized hydrocarbon feedstock is hydrodenitrogenated, thereby yielding a hydrotreated hydrocarbon feedstock. This hydrotreated hydrocarbon feedstock may then be hydrocracked, thereby yielding a hydrocracked hydrocarbon stream. Upon fractionating this hydrocracked hydrocarbon stream, a plurality of streams may be obtained, such as a naphtha stream, a diesel stream, an unconverted bottoms stream, or a combination of two or more of these. The hydrodemetallizing and hydrodesulfurizing take place in at least one hydrodemetallization/hydrodesulfurization reactor having a hydrogen partial pressure from 4 MPa to 8 MPa. The hydrodenitrogenating takes place in at least one hydrodenitrogenation reactor having a hydrogen partial pressure from 8 MPa to 12 MPa. The hydrocracking takes place in at least one hydrocracking reactor having a hydrogen partial pressure from 12 MPa to 20 MPa. The hydrogen partial pressure of the hydrodemetallization/hydrodesulfurization reactor is less than the hydrogen partial pressure of the hydrodenitrogenation reactor, and the hydrogen partial pressure of the hydrodenitrogenation reactor is less than the hydrogen partial pressure of the hydrocracking reactor.

As used herein, the term "hydrocarbon oil" or "hydrocarbon feedstock" refers to an oily liquid composed mostly of a mixture of hydrocarbon compounds. Hydrocarbon oil may include refined oil obtained from crude oil, hydrocarbon mixtures boiling in a range of 350° C. to 750° C., synthetic crude oil, hydrocarbon mixtures containing 1000 parts per million by weight ("ppmw") $C_5$-asphaltenes, bitumen, oil sand, shale oil, or coal oil. The term "refined oil" includes, but is not limited to, vacuum gas oil (VGO), deasphalted oil (DAO) obtained from a solvent deasphalting process, demetallized oil (DMO), light and/or heavy coker gas oil obtained from a coker process, cycle oil obtained from an FCC process, and gas oil obtained from a visbreaking process.

As used herein, the term "hydrocarbon" refers to a chemical compound composed entirely of carbon and hydrogen atoms. An expression such as "$C_x$-$C_y$ hydrocarbon" refers to a hydrocarbon having from x to y carbon atoms. For instance, a $C_1$-$C_5$ hydrocarbon includes methane, ethane, propane, the butanes, and the pentanes.

As used herein, the term "organonitrogen compound" refers to a chemical compound composed of carbon and hydrogen atoms and including at least one nitrogen atom. As used herein, the term "organosulfur compound" refers to a chemical compound composed of carbon and hydrogen atoms and including at least one sulfur atom.

As used herein, the term "conduit" includes casings, liners, pipes, tubes, coiled tubing, and mechanical structures with interior voids.

As used herein, the term "hydrogen/oil ratio" or "hydrogen-to-oil ratio" or "hydrogen-to-hydrocarbon ratio" refers to a standard measure of the volume rate of hydrogen circulating through the reactor with respect to the volume of feed. The hydrogen/oil ratio may be determined by comparing the flow volume of the hydrogen gas stream and the flow volume of the hydrocarbon feed.

As used herein, the term "liquid hourly space velocity" or "LHSV" refers to the ratio of the liquid flow rate of the hydrocarbon feed to the catalyst volume or mass.

As used herein, the term "decreased content" of a substance means that a concentration of the substance is greater before passing through a stage of the process under examination than it is after passing through the stage. As used herein, the term "increased content" of a substance means that a concentration of the substance is greater after passing through a stage of the process under examination than it is before passing through the stage.

In the description of the embodiments that follows, like numerals denote like components across the various figures.

Referring now to FIG. 1, which shows an exemplary process flow diagram of embodiments described herein, the process for refining and hydrocracking a hydrocarbon feedstock may be conducted in apparatus 100. Apparatus 100 may include a hydrodemetallization/hydrodesulfurization reactor 10, hydrodenitrogenation reactor 20, hydrocracking reactor 30, and fractionator 31. The hydrocarbon feedstock may be added to the hydrodemetallization/hydrodesulfurization reactor 10 through conduit 12. Additionally, hydrogen may be added to the hydrodemetallization/hydrodesulfurization reactor 10 through conduit 14. The hydrocarbon feedstock is hydrodemetallized and hydrodesulfurized in the hydrodemetallization/hydrodesulfurization reactor 10 to produce a hydrodemetallized and hydrodesulfurized hydrocarbon feed. As used herein, the term "hydrodemetallized" hydrocarbon feed refers to a hydrocarbon feed with a metal content of less than or equal to 1000 ppmw. As used herein, the term "hydrodesulfurized" hydrocarbon feed refers to a hydrocarbon feed with a sulfur content of less than or equal to 1000 ppmw. Briefly, hydrodemetallization and hydrodesulfurization include reacting the organosulfur and metal-containing compounds present in the hydrocarbon feedstock with hydrogen in the presence of a catalyst.

The hydrodemetallization/hydrodesulfurization reactor 10 may be charged with a catalyst comprising an active phase metal on a support. The metal may be selected from Groups 6, 9, and 10 of the periodic table of elements, as defined in the International Union of Pure and Applied Chemistry Periodic Table released 1 Dec. 2018, and may be composed of more than one such metal. For instance, the active phase metal may be selected from Co—Mo, Ni—Mo, and Co—Ni—Mo. Appropriate supports include, but are not limited to, alumina, silica, titania, and combinations of two or all three of these. In embodiments, the support is alumina. The catalyst may take the form of any appropriate shape, such as extrudates or spheres. In embodiments, the catalyst may be in the form of extrudates.

While in use, the hydrodemetallization/hydrodesulfurization reactor 10 may be operated at an elevated temperature. For instance, the hydrodemetallization/hydrodesulfurization reactor 10 may be operated from 330° C. to 400° C., from 330° C. to 390° C., from 330° C. to 380° C., from 330° C. to 370° C., from 330° C. to 360° C., from 330° C. to 350° C., from 330° C. to 340° C., from 340° C. to 390° C., from 350° C. to 390° C., from 360° C. to 390° C., from 370° C. to 390° C., or even from 380° C. to 390° C.

Hydrogen may be added to the hydrodemetallization/hydrodesulfurization reactor 10 at a partial pressure from 4 MPa to 8 MPa, from 4 MPa to 7.5 MPa, from 4 MPa to 7 MPa, from 4 MPa to 6.5 MPa, from 4 MPa to 6 MPa, from 4 MPa to 5.5 MPa, from 4 MPa to 5 MPa, from 4.5 MPa to 8 MPa, from 5 MPa to 8 MPa, from 5.5 MPa to 8 MPa, from 6 MPa to 8 MPa, from 6.5 MPa to 8 MPa, or even from 7 MPa to 8 MPa. The overall hydrogen-to-oil ratio within the hydrodemetallization/hydrodesulfurization reactor 10 may be from 200 standard liters per liter (StL/L) to 500 StL/L, from 200 StL/L to 450 StL/L, from 200 StL/L to 400 StL/L, from 200 StL/L to 350 StL/L, from 200 StL/L to 300 StL/L, from 250 StL/L to 500 StL/L, from 300 StL/L to 500 StL/L, from 350 StL/L to 500 StL/L, or even from 400 StL/L to 500 StL/L.

In embodiments, the hydrocarbon feedstock and hydrogen may be passed over the catalyst with a liquid hourly space velocity ("LHSV") from 0.5 $h^{-1}$ to 4 $h^{-1}$, from 0.5 $h^{-1}$ to 3.5 $h^{-1}$, from 0.5 $h^{-1}$ to 3 $h^{-1}$, from 0.5 $h^{-1}$ to 2.5 $h^{-1}$, from 0.5 $h^{-1}$ to 2 $h^{-1}$, from 0.5 $h^{-1}$ to 1.5 $h^{-1}$, from 0.5 to 1 $h^{-1}$, from 1 $h^{-1}$ to 4 $h^{-1}$, from 1.5 $h^{-1}$ to 4 $h^{-1}$, from 2 $h^{-1}$ to 4 $h^{-1}$, from 2.5 $h^{-1}$ to 4 $h^{-1}$, or even from 3 $h^{-1}$ to 4 $h^{-1}$.

Upon hydrodemetallization and hydrodesulfurization, the hydrodemetallized and hydrodesulfurized hydrocarbon feedstock may then be added to the hydrodenitrogenation reactor 20 through conduit 16. Additionally, hydrogen may be added to the hydrodenitrogenation reactor 20 through conduit 18. The hydrodemetallized and hydrodesulfurized hydrocarbon feedstock may hydrodenitrogenated in the hydrodenitrogenation reactor 20 to produce a hydrotreated hydrocarbon feedstock. As used herein, the term "hydrodenitrogenated" refers to a hydrocarbon feed with a nitrogen content of less than or equal to 50 ppmw. Briefly, hydrodenitrogenation includes reacting the organonitrogen compounds, such as pyridines, anilines, carbazoles, indoles, pyrroles, and quinolines, present in the hydrodemetallized and hydrodesulfurized hydrocarbon feedstock with hydrogen in the presence of a catalyst.

The hydrodenitrogenation reactor 20 may be charged with a catalyst comprising an active phase metal on a support. The metal may be selected from Groups 6 and 10 of the periodic table of elements, as defined in the International Union of Pure and Applied Chemistry Periodic Table released 1 Dec. 2018, and may be composed of more than one such metal. An exemplary active phase metal is Ni—Mo. Appropriate supports include, but are not limited to, alumina, silica, titania, and combinations of two or all three of these. In embodiments, the support is alumina. The catalyst may take the form of any appropriate shape, such as extrudates or spheres. In embodiments, the catalyst may be in the form of extrudates.

While in use, the hydrodenitrogenation reactor 20 may be operated at an elevated temperature. For instance, the hydrodenitrogenation reactor 20 may be operated from 370° C. to 440° C., from 370° C. to 430° C., from 370° C. to 420° C., from 370° C. to 410° C., from 370° C. to 400° C., from 370° C. to 390° C., from 370° C. to 380° C., from 380° C. to 440° C., from 390° C. to 440° C., from 400° C. to 440° C., from 410° C. to 440° C., from 420° C. to 440° C., or even from 430° C. to 440° C.

Hydrogen may be added to the hydrodenitrogenation reactor 20 at a partial pressure from 8 MPa to 12 MPa, from 8 MPa to 11.5 MPa, from 8 MPa to 11 MPa, from 8 MPa to 10.5 MPa, from 8 MPa to 10 MPa, from 8 MPa to 9.5 MPa, from 8 MPa to 9 MPa, from 8.5 MPa to 12 MPa, from 9 MPa to 12 MPa, from 9.5 MPa to 12 MPa, from 10 MPa to 12 MPa, from 10.5 MPa to 12 MPa, or even from 11 MPa to 12 MPa. The overall hydrogen-to-oil ratio within the hydrodenitrogenation reactor 20 may be from 400 StL/L to 1000 StL/L, from 400 StL/L to 950 StL/L, from 400 StL/L to 900 StL/L, from 400 StL/L to 850 StL/L, from 400 StL/L to 800 StL/L, from 400 StL/L to 750 StL/L, from 400 StL/L to 700 StL/L, from 400 StL/L to 650 StL/L, from 400 StL/L to 600 StL/L, from 400 StL/L to 550 StL/L, from 400 StL/L to 500 StL/L, from 450 StL/L to 1000 StL/L, from 500 StL/L to 1000 StL/L, from 550 StL/L to 1000 StL/L, from 600 StL/L to 1000 StL/L, from 650 StL/L to 1000 StL/L, from 700 StL/L to 1000 StL/L, from 750 StL/L to 1000 StL/L, from 800 StL/L to 1000 StL/L, from 850 StL/L to 1000 StL/L, or even from 900 StL/L to 1000 StL/L.

In embodiments, the hydrodemetallized and hydrodesulfurized hydrocarbon feedstock and hydrogen may be passed over the catalyst with a liquid hourly space velocity ("LHSV") from 0.5 $h^{-1}$ to 4 $h^{-1}$, from 0.5 $h^{-1}$ to 3.5 $h^{-1}$, from 0.5 $h^{-1}$ to 3 $h^{-1}$, from 0.5 $h^{-1}$ to 2.5 $h^{-1}$, from 0.5 $h^{-1}$ to 2 $h^{-1}$, from 0.5 $h^{-1}$ to 1.5 $h^{-1}$, from 0.5 $h^{-1}$ to 1 $h^{-1}$, from 1 $h^{-1}$ to 4 $h^{-1}$, from 1.5 $h^{-1}$ to 4 $h^{-1}$, from 2 $h^{-1}$ to 4 $h^{-1}$, from 2.5 $h^{-1}$ to 4 $h^{-1}$, or even from 3 $h^{-1}$ to 4 $h^{-1}$.

Upon hydrodenitrogenating, the hydrotreated hydrocarbon feedstock may then be added to the hydrocracking reactor 30 through conduit 22. Additionally, hydrogen may be added to the hydrocracking reactor 30 through conduit 24. The hydrotreated hydrocarbon feedstock is hydrocracked in the hydrocracking reactor 30 to produce a hydrocracked hydrocarbon stream. Briefly, hydrocracking includes reacting paraffinic, naphthenic, and unsaturated hydrocarbons, such as aromatics and intermediate olefins, present in the hydrotreated hydrocarbon feedstock with hydrogen in the presence of a catalyst to form saturated hydrocarbons. As used herein, the term "intermediate olefins" refers to unsaturated hydrocarbons that have not yet undergone cracking or hydrogen saturation.

The hydrocracking reactor 30 may be charged with a catalyst comprising an active phase metal on a support. The metal may be selected from Groups 6, 9, and 10 of the periodic table of elements, as defined in the International Union of Pure and Applied Chemistry Periodic Table released 1 Dec. 2018, and may be composed of more than one such metal. An exemplary active phase metal is Ni—Mo. Appropriate supports include, but are not limited to, alumina, silica, titania, a USY zeolite, a BEA zeolite, and combinations of two or more of these. In embodiments, the support is alumina, silica-alumina, a USY zeolite, or a BEA zeolite. The catalyst may take the form of any appropriate shape, such as extrudates or spheres. In embodiments, the catalyst may be in the form of extrudates.

While in use, the hydrocracking reactor 30 may be operated at an elevated temperature. For instance, the hydrocracking reactor 30 may be operated from 370° C. to 500° C., from 370° C. to 440° C., from 370° C. to 430° C., from 370° C. to 420° C., from 370° C. to 410° C., from 370° C. to 400° C., from 370° C. to 390° C., from 370° C. to 380° C., from 380° C. to 500° C., from 390° C. to 500° C., from 400° C. to 500° C., from 410° C. to 500° C., from 420° C. to 500° C., from 430° C. to 500° C., from 440° C. to 500° C., from 450° C. to 500° C., from 460° C. to 500° C., from 470° C. to 500° C., from 480° C. to 500° C., or even from 490° C. to 500° C.

Hydrogen may be added to the hydrocracking reactor 30 at a partial pressure from 12 MPa to 20 MPa, from 12 MPa to 19.5 MPa, from 12 MPa to 19 MPa, from 12 MPa to 18.5 MPa, from 12 MPa to 18 MPa, from 12 MPa to 17.5 MPa, from 12 MPa to 17 MPa, from 12 MPa to 16.5 MPa, from 12 MPa to 16 MPa, from 12 MPa to 15.5 MPa, from 12 MPa to 15 MPa, from 12 MPa to 14.5 MPa, from 12 MPa to 14 MPa, from 12 MPa to 13.5 MPa, from 12 MPa to 13 MPa, from 12 MPa to 12.5 MPa, from 12.5 MPa to 20 MPa, from 13 MPa to 20 MPa, from 13.5 MPa to 20 MPa, from 14 MPa to 20 MPa, from 14.5 MPa to 20 MPa, from 15 MPa to 20 MPa, from 15.5 MPa to 20 MPa, from 16 MPa to 20 MPa, from 16.5 MPa to 20 MPa, from 17 MPa to 20 MPa, from 17.5 MPa to 20 MPa, from 18 MPa to 20 MPa, from 18.5 MPa to 20 MPa, from 19 MPa to 20 MPa, or even from 19.5 MPa to 20 MPa. The overall hydrogen-to-oil ratio within the hydrocracking reactor 30 may be from 1000 StL/L to 2500 StL/L, from 1000 StL/L to 2400 StL/L, from 1000 StL/L to 2300 StL/L, from 1000 StL/L to 2200 StL/L, from 1000 StL/L to 2100 StL/L, from 1000 StL/L to 2000 StL/L, from 1000 StL/L to 1900 StL/L, from 1000 StL/L to 1800 StL/L, from 1000 StL/L to 1700 StL/L, from 1000 StL/L to 1600 StL/L, from 1000 StL/L to 1500 StL/L, from 1000 StL/L to 1400 StL/L, from 1000 StL/L to 1300 StL/L, from 1000 StL/L to 1200 StL/L, from 1000 StL/L to 1100 StL/L, from 1100 StL/L to 2500 StL/L, from 1200 StL/L to 2500 StL/L, from 1300 StL/L to 2500 StL/L, from 1400 StL/L to 2500 StL/L, from 1500 StL/L to 2500 StL/L, from 1600 StL/L to 2500 StL/L, from 1700 StL/L to 2500 StL/L, from 1800 StL/L to 2500 StL/L, from 1900 StL/L to 2500 StL/L, from 2000 StL/L to 2500 StL/L, from 2100 StL/L to 2500 StL/L, from 2200 StL/L to 2500 StL/L, from 2300 StL/L to 2500 StL/L, or even from 2400 StL/L to 2500 StL/L.

In embodiments, the hydrotreated hydrocarbon feedstock and hydrogen may be passed over the catalyst with a liquid hourly space velocity ("LHSV") from 0.5 $h^{-1}$ to 4 $h^{-1}$, from 0.5 $h^{-1}$ to 3.5 $h^{-1}$, from 0.5 $h^{-1}$ to 3 $h^{-1}$, from 0.5 $h^{-1}$ to 2.5 $h^{-1}$, from 0.5 $h^{-1}$ to 2 $h^{-1}$, from 0.5 $h^{-1}$ to 1.5 $h^{-1}$, from 0.5 $h^{-1}$ to 1 $h^{-1}$, from 1 $h^{-1}$ to 4 $h^{-1}$, from 1.5 $h^{-1}$ to 4 $h^{-1}$, from 2 $h^{-1}$ to 4 $h^{-1}$, from 2.5 $h^{-1}$ to 4 $h^{-1}$, or even from 3 $h^{-1}$ to 4 $h^{-1}$.

The hydrocracked hydrocarbon stream may then be added to the fractionator 31 through conduit 26. Fractionator 31 separates components of the hydrocracked hydrocarbon stream into various desirable streams. For instance, a naphtha stream may flow from the fractionator 31 through conduit 28, a kerosene stream may flow from the fractionator 31 through conduit 32, a diesel stream may flow from the fractionator 31 through conduit 34, and an unconverted bottoms stream may be recycled back to the hydrocracking reactor 30 for extinction through conduit 36 or removed from the system through conduit 38. Of course, one, two, or all three of these streams may be released from the fractionator 31 at any given time. As used herein, the term "naphtha" refers to a hydrocarbon stream composed primarily of $C_5$ to $C_8$ hydrocarbons, which boil up to about 180° C. As used herein, the term "kerosene" refers to a hydrocarbon stream that boils in the range 150° C. to 240° C. or is composed primarily of $C_{10}$ to $C_{14}$ hydrocarbons. As used herein, the term "diesel" refers to a hydrocarbon stream that boils in the range 240° C. to 370° C. or is composed primarily of $C_{12}$ to $C_{20}$ hydrocarbons. As used herein, the term "unconverted bottoms" refers to a hydrocarbon stream that boils at 360° C. and above and that contains aromatic hydrocarbons, such as heavy polynuclear aromatics ("HPNAs"). As used herein, the term "extinction" of the unconverted bottoms, for instance, refers to at least 95 wt. % conversion of the feedstock.

In embodiments, the pressure in the fractionator 31 may be from 0.1 MPa to 0.5 MPa, from 0.1 MPa to 0.4 MPa, from 0.1 MPa to 0.3 MPa, from 0.1 MPa to 0.2 MPa, from 0.2 MPa to 0.5 MPa, from 0.3 MPa to 0.5 MPa, or even from 0.4 MPa to 0.5 MPa. The temperature within the fractionator 31 may be from 200° C. to 280° C., from 200° C. to 270° C., from 200° C. to 260° C., from 200° C. to 250° C., from 200° C. to 240° C., from 200° C. to 230° C., from 200° C. to 220° C., from 200° C. to 210° C., from 210° C. to 280° C., from 220° C. to 280° C., from 230° C. to 280° C., from 240° C. to 280° C., from 240° C. to 260° C., from 250° C. to 280° C., from 260° C. to 280° C., or even from 270° C. to 280° C.

Figure 2:
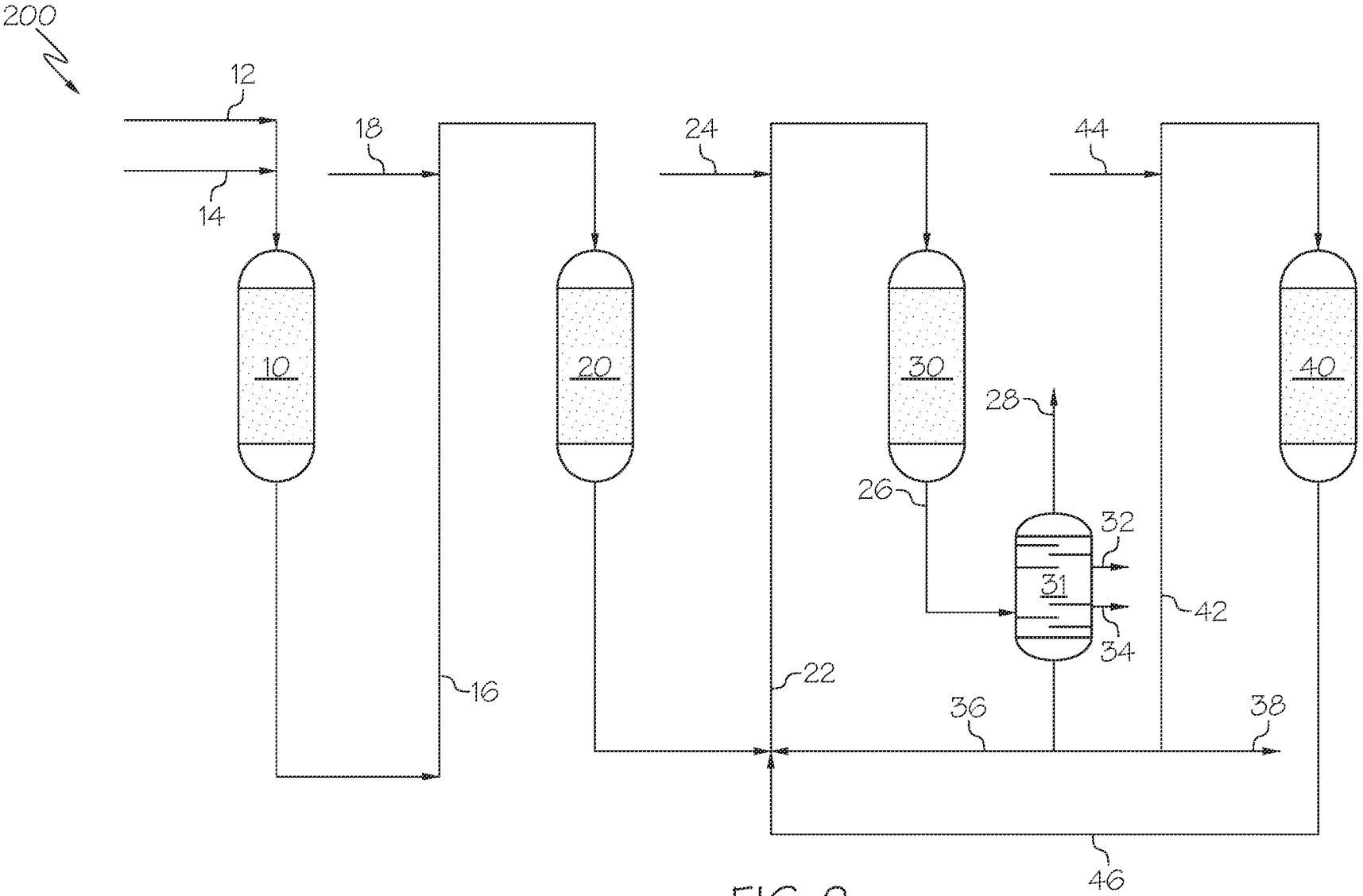
FIG. 2 is a process flow diagram in accordance with embodiments described herein.

In embodiments, rather than being recycled to the hydrocracking reactor 30 for extinction, at least a portion of the unconverted bottoms stream may be added to a hydrogenation reactor 40 of apparatus 200, as shown in FIG. 2, through conduit 42. Briefly, hydrogenating includes reacting aromatic hydrocarbons, such as HPNAs, present in the unconverted bottoms with hydrogen, added to the hydrogenation reactor 40 through conduit 44, in the presence of a catalyst to increase the overall conversion level of the process. Thus, the effluent from the hydrogenation reactor 40, which exits the hydrogenation reactor 40 through conduit 46, has a decreased content of aromatic compounds relative to the unconverted bottoms stream. In embodiments, the hydrogenation reactor 40 effluent may contain 1000 ppmw or less, 900 ppmw or less, 800 ppmw or less, 700 ppmw or less, 600 ppmw or less, 500 ppmw or less, 400 ppmw or less, 300 ppmw or less, 200 ppmw or less, or even 100 ppmw or less aromatic compounds. The resulting effluent may be recycled back to the hydrocracking reactor 30 for extinction through conduit 46.

The hydrogenation reactor 40 may be charged with a catalyst comprising an active phase metal on a support. The metal may be selected from Groups 7, 9, and 10 of the periodic table of elements, as defined in the International Union of Pure and Applied Chemistry Periodic Table released 1 Dec. 2018, and may be composed of more than one such metal. Exemplary active phase metals are Pt, Pd, Rh, Ru. Appropriate supports include, but are not limited to, alumina, silica, titania, a USY zeolite, a BEA zeolite, and combinations of two or more of these. In embodiments, the support is alumina, silica-alumina, a USY zeolite, or a BEA zeolite. The catalyst may take the form of any appropriate shape, such as extrudates or spheres. In embodiments, the catalyst may be in the form of extrudates.

While in use, the hydrogenation reactor 40 may be operated at an elevated temperature. For instance, the hydrogenation reactor 40 may be operated from 250° C. to 350° C., from 250° C. to 340° C., from 250° C. to 330° C., from 250° C. to 320° C., from 250° C. to 310° C., from 250° C. to 300° C., from 250° C. to 290° C., from 250° C. to 280° C., from 250° C. to 270° C., from 250° C. to 260° C., from 260° C. to 350° C., from 270° C. to 350° C., from 280° C. to 350° C., from 290° C. to 350° C., from 300° C. to 350° C., from 310° C. to 350° C., from 320° C. to 350° C., from 330° C. to 350° C., or even from 340° C. to 350° C.

Hydrogen may be added to the hydrogenation reactor 40 at a partial pressure from 6 MPa to 10 MPa, from 6 MPa to 9.5 MPa, from 6 MPa to 9 MPa, from 6 MPa to 8.5 MPa, from 6 MPa to 8 MPa, from 6 MPa to 7.5 MPa, from 6 MPa to 7 MPa, from 6.5 MPa to 10 MPa, from 7 MPa to 10 MPa, from 7.5 MPa to 10 MPa, from 8 MPa to 10 MPa, from 8.5 MPa to 10 MPa, or even from 9 MPa to 10 MPa. The overall hydrogen-to-oil ratio within the hydrogenation reactor 40 may be from 1000 StL/L to 2000 StL/L, from 1000 StL/L to 1950 StL/L, from 1000 StL/L to 1900 StL/L, from 1000 StL/L to 1850 StL/L, from 1000 StL/L to 1800 StL/L, from 1000 StL/L to 1750 StL/L, from 1000 StL/L to 1700 StL/L, from 1000 StL/L to 1650 StL/L, from 1000 StL/L to 1600 StL/L, from 1000 StL/L to 1550 StL/L, from 1000 StL/L to 1500 StL/L, from 1000 StL/L to 1450 StL/L, from 1000 StL/L to 1400 StL/L, from 1000 StL/L to 1350 StL/L, from 1000 StL/L to 1300 StL/L, from 1000 StL/L to 1250 StL/L, from 1000 StL/L to 1200 StL/L, from 1000 StL/L to 1150 StL/L, from 1000 StL/L to 1100 StL/L, from 1050 StL/L to 2000 StL/L, from 1100 StL/L to 2000 StL/L, from 1150 StL/L to 2000 StL/L, from 1200 StL/L to 2000 StL/L, from 1250 StL/L to 2000 StL/L, from 1300 StL/L to 2000 StL/L, from 1350 StL/L to 2000 StL/L, from 1400 StL/L to 2000 StL/L, from 1450 StL/L to 2000 StL/L, from 1500 StL/L to 2000 StL/L, from 1550 StL/L to 2000 StL/L, from 1600 StL/L to 2000 StL/L, from 1650 StL/L to 2000 StL/L, from 1700 StL/L to 2000 StL/L, from 1750 StL/L to 2000 StL/L, from 1800 StL/L to 2000 StL/L, from 1850 StL/L to 2000 StL/L, or even from 1900 StL/L to 2000 StL/L.

In embodiments, the unconverted bottoms and hydrogen may be passed over the catalyst with a liquid hourly space velocity ("LHSV") from 1 $h^{-1}$ to 4 $h^{-1}$, from 1 $h^{-1}$ to 3.5 $h^{-1}$, from 1 $h^{-1}$ to 3 $h^{-1}$, from 1 $h^{-1}$ to 2.5 $h^{-1}$, from 1 $h^{-1}$ to 2 $h^{-1}$, from 1.5 $h^{-1}$ to 4 $h^{-1}$, from 2 $h^{-1}$ to 4 $h^{-1}$, from 2.5 $h^{-1}$ to 4 $h^{-1}$, or even from 3 $h^{-1}$ to 4 $h^{-1}$.

Figure 3:
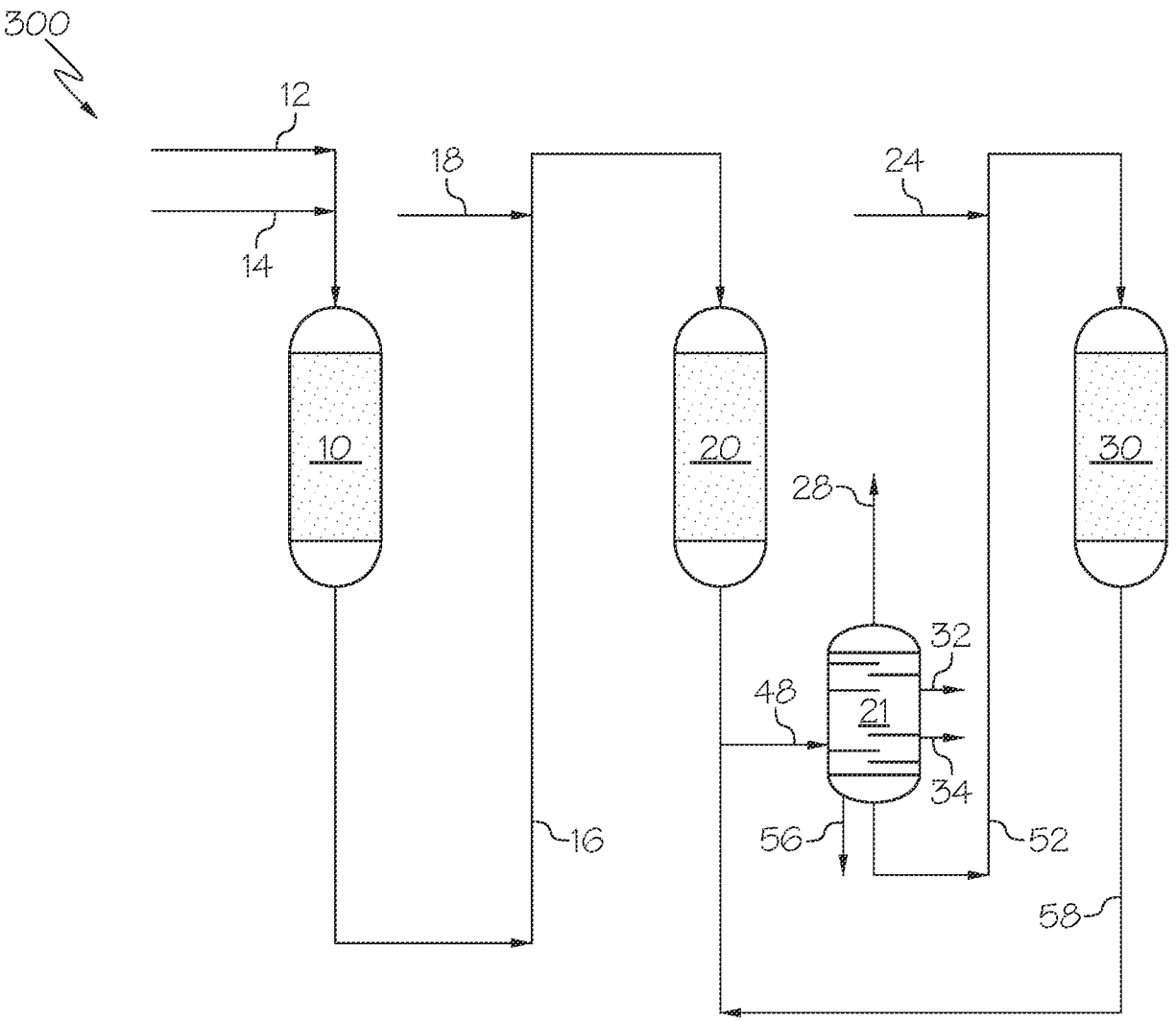
FIG. 3 is a process flow diagram in accordance with embodiments described herein.

As shown in FIG. 3, in embodiments, the fractionator 21 of apparatus 300 may be shifted to downstream of the hydrodenitrogenation reactor 20 and upstream of the hydrocracking reactor 30. The hydrotreated hydrocarbon stream from the hydrodenitrogenation reactor 20 may be added to the fractionator 21 through conduit 48. The hydrodenitrogenation reactor 20 operates at conditions that may give rise to cracking, thereby removing nitrogen compounds as discussed above, and also producing the $C_1$-$C_4$ gases, hydrogen sulfide, ammonia, naphtha, kerosene, diesel, and unconverted bottoms discussed above. Therefore, in this configuration, the fractionator 21 separates the $C_1$-$C_4$ gases, hydrogen sulfide, ammonia, naphtha, kerosene, and diesel formed in the hydrodenitrogenation reactor 20, to prevent further cracking of these products. In FIG. 3, the $C_1$-$C_4$ gases, hydrogen sulfide, ammonia, naphtha, kerosene, and diesel are indicated as exiting the fractionator 21 through conduit 28, conduit 32, and conduit 34. The unconverted bottoms stream is added to the hydrocracking reactor 30 through conduit 52 or may be collected via conduit 56. The fraction containing unconverted bottoms is then hydrocracked in the hydrocracking reactor 30, thereby producing one or more hydrocracked hydrocarbon streams, such as a naphtha stream, a diesel stream, an unconverted bottoms stream, or a combination of two or more of these. The reactor effluents may be sent through conduit 58 to the fractionator 31 for separation.

Figure 4:
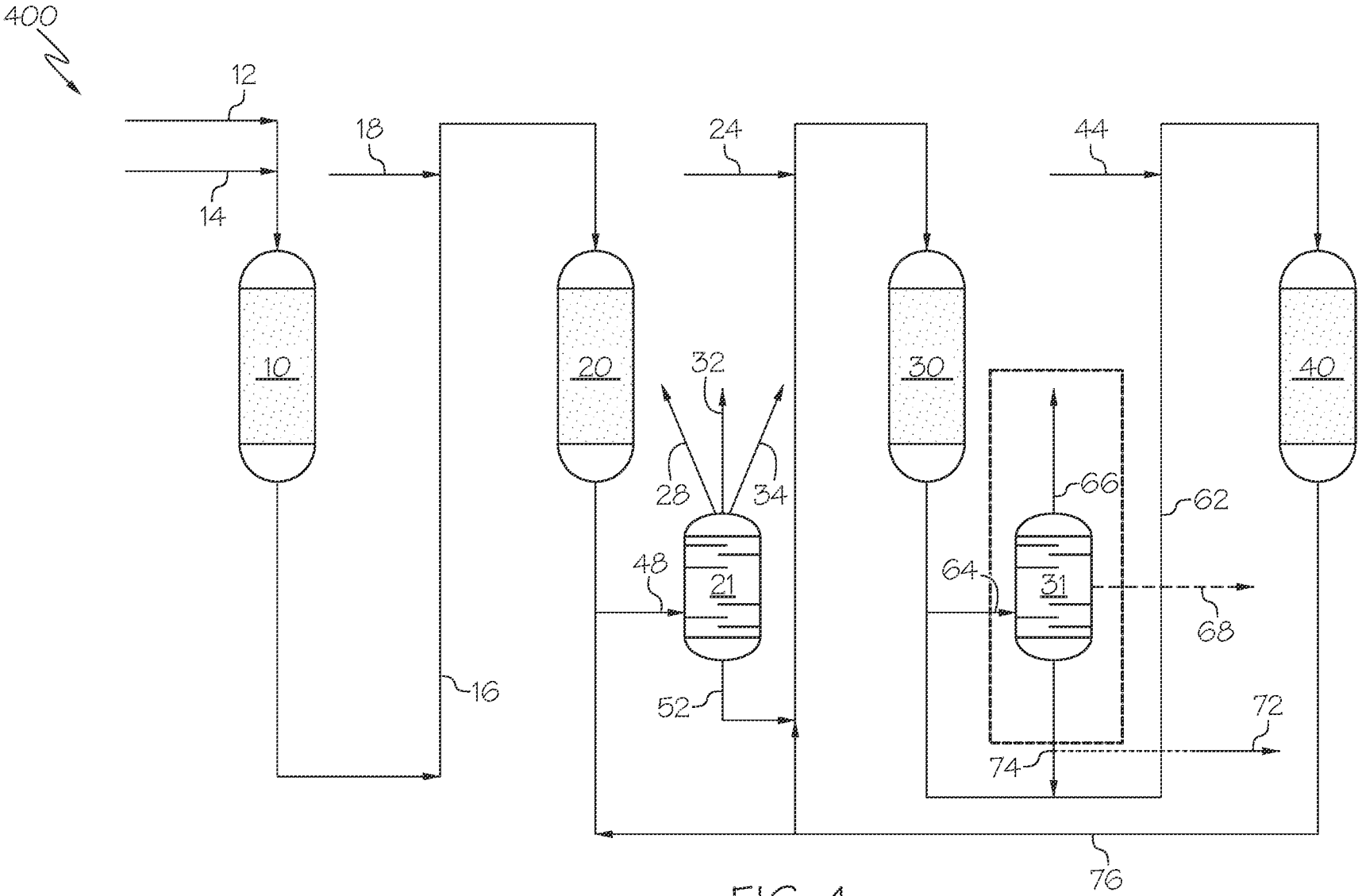
FIG. 4 is a process flow diagram in accordance with embodiments described herein.

In embodiments, as shown in FIG. 4, apparatus 400 may include a hydrogenation reactor 40, and a fractionator 21 may be placed downstream of the hydrodenitrogenation reactor 20 and upstream of the hydrocracking reactor 30. Additionally, an optional second fractionator 31 may be placed downstream of the hydrocracking reactor 30 and upstream of the hydrogenation reactor 40. In operation, the hydrotreated hydrocarbon stream may be added to the fractionator 21 through conduit 48. Within the fractionator 21, the hydrodenitrogenated hydrocarbon stream may be separated into the $C_1$-$C_4$ gases, hydrogen sulfide, ammonia, naphtha, kerosene, diesel, and unconverted bottoms streams as in the embodiment shown in FIG. 2.

A fraction containing unconverted bottoms is added to the hydrocracking reactor 30 through conduit 52. The fraction containing uncoverted bottoms is then hydrocracked in the hydrocracking reactor 30, thereby producing a hydrocracking reactor effluent stream that may be either added directly to the hydrogenation reactor 40 through conduit 62 or may be fed to the optional second fractionator 31 through conduit 64. In the optional second fractionator 31, the hydrocracking reactor effluent is separated into one or more product streams, such as a naphtha stream, which may exit the optional second fractionator 31 though conduit 66, a kerosene stream, which may exit the optional second fractionator 31 through conduit 68, a diesel stream, which may exit the optional second fractionator 31 though conduit 72, and an unconverted bottoms stream, which may exit the optional second fractionator 31 though conduit 74 and be recycled to the hydrocracking reactor 30 or fed into to the hydrogenation reactor 40. The effluent from the hydrogenation reactor 40, which exits the hydrogenation reactor 40 through conduit 76, has a decreased content of aromatic compounds relative to the unconverted bottoms stream. In embodiments, the hydrogenation reactor 40 effluent may contain 1000 ppmw or less, 900 ppmw or less, 800 ppmw or less, 700 ppmw or less, 600 ppmw or less, 500 ppmw or less, 400 ppmw or less, 300 ppmw or less, 200 ppmw or less, or even 100 ppmw or less aromatic compounds. The resulting effluent may be recycled back directly to the hydrocracking reactor 30 or to the fractionator 21 for extinction through conduit 76.

In embodiments, the hydrogen partial pressure of the hydrodemetallization/hydrodesulfurization reactor 10 is less than the hydrogen partial pressure of the hydrodenitrogenation reactor 20, and the hydrogen partial pressure of the hydrodenitrogenation reactor 20 is less than the hydrogen partial pressure of the hydrocracking reactor 30. In embodiments, the difference between the hydrogen partial pressure of each reactor is from 3 MPa to 5 MPa, such as about 4 MPa. For instance, and not by way of limitation, if the hydrogen partial pressure of the hydro-demetallization/hydrodesulfurization reactor 10 is about 4 MPa, the hydrogen partial pressure of the hydrodenitrogenation reactor 20 may be about 8 MPa, and the hydrogen partial pressure of the hydrocracking reactor 30 may be about 12 MPa According to a first aspect, either alone or in combination with any other aspect, a process for refining and hydrocracking a hydrocarbon feedstock includes hydrodemetallizing and hydrodesulfurizing the hydrocarbon feedstock thereby yielding a hydrodemetallized and hydrodesulfurized hydrocarbon feedstock; hydrodenitrogenating the hydrodemetallized and hydrodesulfurized hydrocarbon feedstock, thereby yielding a hydrotreated hydrocarbon feedstock; hydrocracking the hydrotreated hydrocarbon feedstock, thereby yielding a hydrocracked hydrocarbon stream; and fractionating the hydrocracked hydrocarbon stream, thereby yielding a plurality of streams selected from the group consisting of a naphtha stream, a diesel stream, an unconverted bottoms stream, and a combination of two or more thereof. The hydrodemetallizing and hydrodesulfurizing take place in at least one hydrodemetallization/hydrodesulfurization reactor having a hydrogen partial pressure from 4 MPa to 8 MPa. The hydrodenitrogenating takes place in at least one hydrodenitrogenation reactor having a hydrogen partial pressure from 8 MPa to 12 MPa. The hydrocracking takes place in at least one hydrocracking reactor having a hydrogen partial pressure from 12 MPa to 20 MPa. The hydrogen partial pressure of the hydrodemetallization/hydrodesulfurization reactor is less than the hydrogen partial pressure of the hydrodenitrogenation reactor, and the hydrogen partial pressure of the hydrodenitrogenation reactor is less than the hydrogen partial pressure of the hydrocracking reactor.

According to a second aspect, either alone or in combination with any other aspect, the process further comprises hydrogenating at least a portion of the unconverted bottoms stream, thereby producing a hydrogenation reactor effluent stream.

According to a third aspect, either alone or in combination with any other aspect, the process further comprises recycling at least a portion of the unconverted bottoms stream to the hydrocracking reactor.

According to a fourth aspect, either alone or in combination with any other aspect, the process further comprises recycling at least a portion of the hydrogenation reactor effluent stream to the hydrocracking reactor.

According to a fifth aspect, either alone or in combination with any other aspect, the hydrodemetallizing and hydrodesulfurizing take place in at least one hydrodemetallization/hydrodesulfurization reactor at a pressure from 4 MPa to 6 MPa.

According to a sixth aspect, either alone or in combination with any other aspect, the hydrodenitrogenating takes place in at least one hydrodenitrogenation reactor at a pressure from 8 MPa to 9 MPa.

According to a seventh aspect, either alone or in combination with any other aspect, the hydrocracking takes place in at least one hydrocracking reactor at a pressure from 12 MPa to 16 MPa.

According to an eighth aspect, either alone or in combination with any other aspect, the hydrogenating takes place in at least one hydrogenation reactor at a pressure from 6 MPa to 10 MPa.

According to a ninth aspect, either alone or in combination with any other aspect, the hydrogenation reactor is at a pressure from 6 MPa to 8 MPa.

According to a tenth aspect, either alone or in combination with any other aspect, a process for refining and hydrocracking a hydrocarbon feedstock includes hydrodemetallizing and hydrodesulfurizing the hydrocarbon feedstock thereby yielding a hydrodemetallized and hydrodesulfurized hydrocarbon feedstock; hydrodenitrogenating the hydrodemetallized and hydrodesulfurized hydrocarbon feedstock, thereby yielding a hydrotreated hydrocarbon feedstock; fractionating the hydrotreated hydrocarbon feedstock, thereby yielding a plurality of streams, one of the plurality of streams comprising unconverted bottoms; and hydrocracking the unconverted bottoms, thereby yielding one or more hydrocracked hydrocarbon streams selected from the group consisting of a naphtha stream, a diesel stream, an unconverted bottoms stream, and a combination of two or more thereof. The hydrodemetallizing and hydrodesulfurizing take place in at least one hydrodemetallization/hydrodesulfurization reactor at a pressure from 4 MPa to 8 MPa. The hydrodenitrogenating takes place in at least one hydrodenitrogenation reactor at a pressure from 8 MPa to 12 MPa. The hydrocracking takes place in at least one hydrocracking reactor at a pressure from 12 MPa to 20 MPa. The hydrogen partial pressure of the hydrodemetallization/hydrodesulfurization reactor is less than the hydrogen partial pressure of the hydrodenitrogenation reactor, and the hydrogen partial pressure of the hydrodenitrogenation reactor is less than the hydrogen partial pressure of the hydrocracking reactor.

According to a eleventh aspect, either alone or in combination with any other aspect, the process further comprises hydrogenating at least a portion of the unconverted bottoms stream, thereby producing a hydrogenation reactor effluent stream.

According to a twelfth aspect, either alone or in combination with any other aspect, the process further comprises recycling at least a portion of the unconverted bottoms stream to the hydrocracking reactor.

According to a thirteenth aspect, either alone or in combination with any other aspect, the process further comprises recycling at least a portion of the hydrogenation reactor effluent stream to the hydrocracking reactor.

According to a fourteenth aspect, either alone or in combination with any other aspect, fractionating the hydrocracked hydrocarbon feedstock, thereby yielding a plurality of streams.

According to a fifteenth aspect, either alone or in combination with any other aspect, the hydrodemetallizing and hydrodesulfurizing take place in at least one hydrodemetallization/hydrodesulfurization reactor at a pressure from 4 MPa to 6 MPa.

According to a sixteenth aspect, either alone or in combination with any other aspect, the hydrodenitrogenating takes place in at least one hydrodenitrogenation reactor at a pressure from 8 MPa to 9 MPa.

According to a seventeenth aspect, either alone or in combination with any other aspect, the hydrocracking takes place in at least one hydrocracking reactor at a pressure from 12 MPa to 16 MPa.

According to an eighteenth aspect, either alone or in combination with any other aspect, the hydrogenating takes place in at least one hydrogenation reactor at a pressure from 6 MPa to 10 MPa.

According to a nineteenth aspect, either alone or in combination with any other aspect, the hydrogenation reactor is at a pressure from 6 MPa to 8 MPa.

EXAMPLES

Using embodiments described above, an exemplary scheme for refining and hydrocracking a hydrocarbon feedstock was performed.

Example 1 (Comparative): "Two Step, Once Thru" Hydrocracking (Pretreat+Hydrocracking Pretreat Step (Hydrotreating)

A two reactor pilot plant was used to hydrocrack a VGO feedstock. The composition and properties of the VGO feedstock are given in Table 1. In Table 1, the boiling range distribution of the hydrocarbon feedstock, in accordance with ASTM D2887, is reported as the temperature by which a certain concentration (in wt. %) of the feedstock has evaporated, as well as an initial and final boiling point. The first reactor was loaded with 100 ml of a commercial pretreat catalyst (Ni—Mo/Si—Al) followed by 100 ml of hydrocracking catalyst (Ni—Mo/Si—Al/Zeolite). The zeolite of the catalyst was an Ultra-Stable Y-type ("USY") zeolite that had been dealuminated and then modified by titanium and zirconium insertion. The pilot plant was operated at a temperature of 375° C., a hydrogen partial pressure of 13.5 MPa, a hydrogen-to-oil ratio of 1000 StL/L, and an LHSV of 0.5 $h^{-1}$. The process performance and product yields are given in Table 2. For the product yields, the gas fraction was defined as the fraction primarily composed of $C_1$-$C_4$ hydrocarbons, the naphtha fraction was defined as the fraction primarily composed of $C_5$ hydrocarbons through species boiling at 145° C., the kerosene fraction was defined as the fraction primarily composed of species boiling in the 145° C. to 260° C. range, the gasoil fraction was defined as the fraction primarily composed of species boiling in the 260° C. to 360° C. range, the unconverted bottoms fraction was defined as the fraction primarily composed of species boiling at 360° C. and above. Kerosene and gasoil combined are referred to as the "middle distillates."

TABLE 1

| Feedstock Composition and Properties | |
|---|---|
| Property | Value |
| Specific Gravity (g/cm$^3$) | 0.921 |
| API Gravity | 22.1 |
| Sulfur (wt. %) | 2.512 |
| Nitrogen (ppmw) | 960 |
| Aromatic carbon (wt. %) | 19.7 |
| ASTM D2887 Boiling Range Distribution | |
| Evaporate (wt. %) | Temperature (° C.) |
| IBP | 172 |
| 5 | 250 |
| 10 | 291 |
| 30 | 356 |
| 50 | 397 |

TABLE 1-continued

| | |
|---|---|
| 70 | 440 |
| 90 | 494 |
| 95 | 514 |
| FBP | 549 |

1 IBP = initial boiling point;
2 FBP = final boiling point.

| Process Performance and Product Yields | |
|---|---|
| Performance | |
| Property | Value |
| Conversion of 370° C.+ fraction (wt. %) | 41.5 |
| Sulfur removed (wt. %) | 99.9 |
| Nitrogen removed (wt. %) | 99.9 |
| AP Gravity Increase | 14.8 |
| Product Yields | |
| Products | Yield (wt.%) |
| Gas ($C_1$-$C_4$) | 1.1 |
| Naphtha ($C_5$-145° C.) | 3.7 |
| Kerosene (145° C.-260° C.) | 21.3 |
| Gasoil (260° C.-360° C.) | 23.7 |
| Middle Distillates (145° C.-360° C.) | 45.0 |
| Unconverted Bottoms (360° C.+) | 50.2 |

As shown in Table 2, 41.5 wt. % of the 370° C. and above boiling fraction was converted in this comparative example. Sulfur was reduced from 2,512 wt. % (25,120 ppmw) to 20 ppmw, a 99.9 wt % reduction. Nitrogen was reduced from 980 ppmw to 1 ppmw, also a 99.9 wt. % reduction.

Hydrocracking Step

The pretreatment reactor effluents were sent to a hydrocracking reactor, which was operated at a temperature of 391° C., a hydrogen partial pressure of 13.5 MPa, a hydrogen-to-oil ratio of 1000 StL/L, and an LHSV of 0.5 $h^{-1}$. An overall conversion of 86.9 wt % was achieved. The product yields are given in Table 3, using the same definitions provided as to Table 2. This process provided 66.8 wt % of middle distillates.

TABLE 2

| Product Yields of the Pretreat and Hydrocracking Steps | |
|---|---|
| Products | Yield (wt. %) |
| Gas ($C_1$-$C_4$) | 2.2 |
| Naphtha ($C_5$-145° C.) | 19.8 |
| Kerosene (145° C.-260° C.) | 45.0 |
| Gasoil (260° C.-360° C.) | 21.8 |
| Middle Distillates (145° C.-360° C.) | 66.8 |
| Unconverted Bottoms (360° C.+) | 11.2 |

Example 2 (Inventive): "Three Step Hydrocracking" (System Shown in FIG. 1)

Hydrodesulfurization Step

The VGO feedstock used in the comparative Example 1 was hydrodesulfurized over a catalyst composition containing Ni—Mo as the active phase metal and alumina as the support. The reactor was operated at a temperature of 370° C., a hydrogen partial pressure of 4 MPa, a hydrogen-to-oil ratio of 500 StL/L, and an LHSV of 1 $h^{-1}$. 31.4 wt. % of the 370° C. and above boiling fraction was converted under these conditions. Sulfur was reduced from 2,512 wt. % to 1217 ppmw, a 95.2 wt. % reduction. Nitrogen was reduced from 980 ppmw to 389 ppmw, a 60.3 wt. % reduction.

Hydrodenitrogenation Step

The effluents from the hydrodesulfurization step were hydrodenitrogenated over a catalyst comprising Ni—Mo on a silica-alumina support. The reactor was operated at a temperature of 385° C., a hydrogen partial pressure of 8 MPa, a hydrogen-to-oil ratio of 500 StL/L, and an LHSV of 0.5 $h^{-1}$. An additional 21 wt. % conversion was obtained in this step, resulting in an overall conversion of 52.4 wt. %. Sulfur was reduced from 1217 ppmw to 54 ppmw, a 95.6 wt. % reduction for this step and a 99.8 wt. % overall reduction. Nitrogen was reduced from 389 ppmw to 11 ppmw, a 97.2 wt. % reduction for this step and a 98.9 wt. % overall reduction.

Hydrocracking Step

The effluents from the hydrodenitrogenation step were hydrocracked over a Ni—Mo and Ti—Zr modified USY zeolite and alumina, which was used as a binder. The reactor was operated at a temperature of 390° C., a hydrogen partial pressure of 13.5 MPa, a hydrogen-to-oil ratio of 1000 StL/L, and an LHSV of 0.5 $h^{-1}$. An additional 35 wt. % conversion was obtained in this step, resulting in an overall conversion of 87.4 wt. %, which is practically identical to the yield of comparative Example 1. Thus, the same level of performance was obtained by separating the pretreat step into two sections and operating the two sections at a lower hydrogen partial pressure severity.

Example 3: Comparison of Costs

An inventive three step pressure cascaded hydrocracking process is compared to a two step hydrocracking process. For the comparative system, a four reactor (two-stage) once-thru hydrocracking unit is used. This system contains two reactors with 75 volume % (vol. %) catalyst capacity in the pretreat section and two reactors with 25 vol. % catalyst capacity in the hydrocracking section. The hydrogen partial pressure in the comparative system is 13.5 MPa. The system of the inventive Example 2 has an average hydrogen partial pressure of 7.9 MPa. The pressure cascaded hydrocracking unit represents a capital cost savings over the comparative two step hydrocracking unit of about 32%.

It is noted that recitations in the present disclosure of a component of the present disclosure being "operable" or "sufficient" in a particular way, to embody a particular property, or to function in a particular manner, are structural recitations, as opposed to recitations of intended use. More specifically, the references in the present disclosure to the manner in which a component is "operable" or "sufficient" denotes an existing physical condition of the component and, as such, is to be taken as a definite recitation of the structural characteristics of the component.

The singular forms "a," "an" and "the" include plural referents, unless the context clearly dictates otherwise.

Throughout this disclosure ranges are provided. It is envisioned that each discrete value encompassed by the ranges are also included. Additionally, the ranges which may be formed by each discrete value encompassed by the explicitly disclosed ranges are equally envisioned.

As used in this disclosure and in the appended claims, the words "comprise," "has," and "include" and all grammatical variations thereof are each intended to have an open, non-limiting meaning that does not exclude additional elements or steps.

As used in this disclosure, terms such as "first" and "second" are arbitrarily assigned and are merely intended to differentiate between two or more instances or components. It is to be understood that the words "first" and "second" serve no other purpose and are not part of the name or description of the component, nor do they necessarily define a relative location, position, or order of the component. Furthermore, it is to be understood that that the mere use of the term "first" and "second" does not require that there be any "third" component, although that possibility is contemplated under the scope of the present disclosure.

Having described the subject matter of the present disclosure in detail and by reference to specific embodiments, it is noted that the various details disclosed in the present disclosure should not be taken to imply that these details relate to elements that are essential components of the various embodiments described in the present disclosure. Further, it will be apparent that modifications and variations are possible without departing from the scope of the present disclosure, including, but not limited to, embodiments defined in the appended claims.

What is claimed is:

1. A process for refining and hydrocracking a hydrocarbon feedstock, the method comprising:

hydrodemetallizing and hydrodesulfurizing the hydrocarbon feedstock thereby yielding a hydrodemetallized and hydrodesulfurized hydrocarbon feedstock;

hydrodenitrogenating the hydrodemetallized and hydrodesulfurized hydrocarbon feedstock, thereby yielding a hydrotreated hydrocarbon feedstock;

hydrocracking the hydrotreated hydrocarbon feedstock, thereby yielding a hydrocracked hydrocarbon stream;

fractionating the hydrocracked hydrocarbon stream, thereby yielding a plurality of streams selected from the group consisting of a naphtha stream, a diesel stream, an unconverted bottoms stream, and a combination of two or more thereof;

hydrogenating at least a portion of the unconverted bottoms stream, thereby producing a hydrogenation reactor effluent stream; and recycling at least a portion of the hydrogenation reactor effluent stream to the hydrocracking reactor;

wherein the hydrodemetallizing and hydrodesulfurizing take place in at least one hydrodemetallization/hydrodesulfurization reactor having a hydrogen partial pressure from 4 MPa to 8 MPa;

the hydrodenitrogenating takes place in at least one hydrodenitrogenation reactor having a hydrogen partial pressure from 8 MPa to 12 MPa;

the hydrocracking takes place in at least one hydrocracking reactor having a hydrogen partial pressure from 12 MPa to 20 MPa; and the hydrogen partial pressure of the hydrodemetallization/hydrodesulfurization reactor is less than the hydrogen partial pressure of the hydrodenitrogenation reactor, and the hydrogen partial pressure of the hydrodenitrogenation reactor is less than the hydrogen partial pressure of the hydrocracking reactor.

2. The process of claim 1, further comprising recycling at least a portion of the unconverted bottoms stream to the hydrocracking reactor.

3. The process of claim 1, wherein the hydrodemetallizing and hydrodesulfurizing take place in at least one hydrodemetallization/hydrodesulfurization reactor at a pressure from 4 MPa to 6 MPa.

4. The process of claim 1, wherein the hydrodenitrogenating takes place in at least one hydrodenitrogenation reactor at a pressure from 8 MPa to 9 MPa.

5. The process of claim 1, wherein the hydrocracking takes place in at least one hydrocracking reactor at a pressure from 12 MPa to 16 MPa.

6. The process of claim 1, wherein the hydrogenating takes place in at least one hydrogenation reactor at a pressure from 6 MPa to 10 MPa.

7. The process of claim 6, wherein the hydrogenation reactor is at a pressure from 6 MPa to 8 MPa.

8. A process for refining and hydrocracking a hydrocarbon feedstock, the method comprising:

hydrodemetallizing and hydrodesulfurizing the hydrocarbon feedstock thereby yielding a hydrodemetallized and hydrodesulfurized hydrocarbon feedstock;

hydrodenitrogenating the hydrodemetallized and hydrodesulfurized hydrocarbon feedstock, thereby yielding a hydrotreated hydrocarbon feedstock;

fractionating the hydrotreated hydrocarbon feedstock, thereby yielding a plurality of streams, one of the plurality of streams comprising unconverted bottoms;

hydrocracking the unconverted bottoms, thereby yielding one or more hydrocracked hydrocarbon streams selected from the group consisting of a naphtha stream, a diesel stream, an unconverted bottoms stream, and a combination of two or more thereof;

hydrogenating at least a portion of the unconverted bottoms stream, thereby producing a hydrogenation reactor effluent stream; and recycling at least a portion of the hydrogenation reactor effluent stream to the hydrocracking reactor;

wherein the hydrodemetallizing and hydrodesulfurizing take place in at least one hydrodemetallization/hydrodesulfurization reactor at a pressure from 4 MPa to 8 MPa;

the hydrodenitrogenating takes place in at least one hydrodenitrogenation reactor at a pressure from 8 MPa to 12 MPa;

the hydrocracking takes place in at least one hydrocracking reactor at a pressure from 12 MPa to 20 MPa; and the hydrogen partial pressure of the hydrodemetallization/hydrodesulfurization reactor is less than the hydrogen partial pressure of the hydrodenitrogenation reactor, and the hydrogen partial pressure of the hydrodenitrogenation reactor is less than the hydrogen partial pressure of the hydrocracking reactor.

9. The process of claim 8, further comprising recycling at least a portion of the unconverted bottoms stream to the hydrocracking reactor.

10. The process of claim 8, further comprising fractionating the hydrocracked hydrocarbon feedstock, thereby yielding a plurality of streams.

11. The process of claim 8, wherein the hydrodemetallizing and hydrodesulfurizing take place in at least one hydrodemetallization/hydrodesulfurization reactor at a pressure from 4 MPa to 6 MPa.

12. The process of claim 8, wherein the hydrodenitrogenating takes place in at least one hydrodenitrogenation reactor at a pressure from 8 MPa to 9 MPa.

13. The process of claim 8, wherein the hydrocracking takes place in at least one hydrocracking reactor at a pressure from 12 MPa to 16 MPa.

14. The process of claim 8, wherein the hydrogenating takes place in at least one hydrogenation reactor at a pressure from 6 MPa to 10 MPa.

15. The process of claim 14, wherein the hydrogenation reactor is at a pressure from 6 MPa to 8 MPa.

* * * * *